US006715637B1

(12) United States Patent
Ramos

(10) Patent No.: US 6,715,637 B1
(45) Date of Patent: Apr. 6, 2004

(54) COMBINATION STORAGE/DISPENSER FOR HOLLOW-CORED PAPER ROLL

(76) Inventor: Amando C. Ramos, 7907 Neyland Way, Sacramento, CA (US) 95829

( * ) Notice: Subject to any disclaimer, the term of this patent is extended or adjusted under 35 U.S.C. 154(b) by 26 days.

(21) Appl. No.: 09/967,536

(22) Filed: Sep. 28, 2001

(51) Int. Cl.[7] ..... B65H 3/00
(52) U.S. Cl. ..... 221/196; 242/560
(58) Field of Search ..... 242/579, 588.6, 242/593, 560, 597.7, 559.3, 560.1; 221/194, 196, 283, 266, 297, 301

(56) References Cited

U.S. PATENT DOCUMENTS 4,520,968 A * 6/1985 Shpigelman ..... 225/47
5,449,127 A * 9/1995 Davis ..... 242/560
6,161,794 A * 12/2000 Cravatt ..... 242/560

* cited by examiner

*Primary Examiner*—Kenneth W. Noland

(57) ABSTRACT

A combination storage/dispenser (FIG. 1D) for toilet paper comprising: a hopper (10) for holding a plurality of rolls stacked co-axially with and inside said hopper (10); a base (42) having at its center, a shaft (44) with a smaller-diameter extension (44*a*) is directly and precisely positioned below said hopper (10); a shield (48) projecting from its edge normally to its plane, and a plurality of shallow slots (50) around its periphery connected by channels (52) in a circular path; a starwheel (22) mounted on and supported by said shaft extension (44*a*) through its hub (26) has a plurality of cutouts (24) around its periphery; a toilet paper holder rod (28) stands at the bottom of each said cutouts (24); a sleeve (56) projecting from the backside (FIG. 1G) of said starwheel (22) houses a spindle (32) and a coil spring (36) that forcibly keeps said spindle (32) on channels (52); the spring-loaded spindle (32) and slots (50) combination facilitates indexed rotation of said starwheel (22) to simultaneously perform its three-event cyclic function.

14 Claims, 8 Drawing Sheets

COMBINATION STORAGE/DISPENSER FOR HOLLOW-CORED PAPER ROLL

BACKGROUND

1. Field of the Invention

Figure 1A:
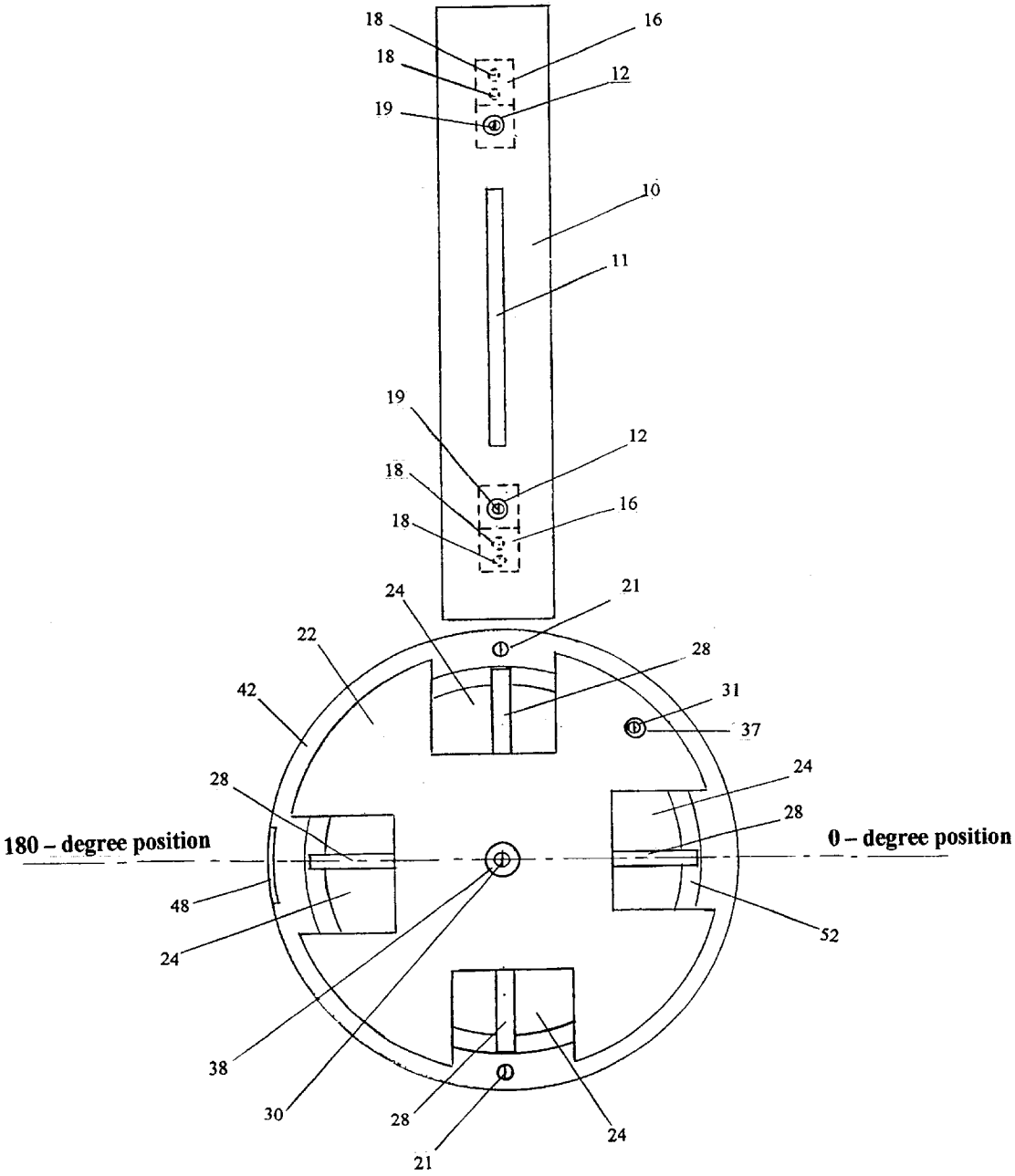

This invention relates to hollow-cored rolled sheet of paper holder/dispenser, specifically to such holder/dispenser which is used for holding rolls of toilet tissue paper, paper towel, and similar commodities to be manually dispensed by human.

2. Background of the Prior Art

Through the past decades considerable number of prior art in the field of dispensing toilet paper, towel paper, and similar commodities having cylindrical tube axially located at the center of said commodities have been advanced and been granted patent protection. Each one of said prior art devices presents different features and configuration or improvement over the previous ones. Obviously each of the thinkers behind those proposed improvements was cognizant of the need to provide a dispensing device that accomplishes mainly, among other things, two basic functions namely: (1) to store an ample supply of rolls of toilet paper in a designated component of said device to make them available and ready for the user upon demand, and (2) to position a roll of toilet paper in another component of said device in a manner in which a user can easily unroll a sheet of material from it. To perform the aforementioned two basic functions, most prior art devices commonly include two basic components, namely: (1) a storage component for holding an ample supply of rolls of toilet paper. Said component is named differently by different inventors. Some call it a tube, others name it a magazine, still others call it a hopper, some refer to it as a box, and a second component (2) a dispensing section of the device generally positioned below said first component and serves as a surge or queue chamber and provides a passageway for a roll of toilet paper when a member part of said component pushes or otherwise moves said roll of toilet paper to a dispensing position ready for dispension by a user. Said second component generally includes more movable mechanical parts than the first component for the simple reason that manual interface with the device through said second component is required to move a roll of toilet paper to the dispension position and this is accomplished by actuating the proper part(s) of said second component. Whereas said first component (the magazine) generally utilizes only the gravitational force to drop a roll of toilet paper from a stack within it down to the second component underneath. However, many of the proposed prior art devices that have successfullly employed the two-component-combination described above to accomplish the aforementioned two basic functions still continue to use a spindle which is manually inserted into the cardboard tube at the center of the toilet paper roll and then positioning it in a receptacle wherefrom a user can unroll a sheet of material when needed. Other prior art devices employ complex mechanical components such as linkages, arm-cam (ratchet) combination, etc. to display a roll of toilet paper in a dispension position for a user's consumption. Such arrangements may not be cost effective to manufacture hampering the device's competitive edge in the market. Moreover, inefficient space utilization results when a roll of toilet paper is brought forward to the dispension position by an arm-cam mechanism as in Shpigelman's U.S. Pat. No. 4,520,968 which puts a roll of toilet paper more than two paper roll diameters outward from a bathroom wall. Aesthetic aspects also suffer with bulky artless mechanical design exhibited by some prior art devices which were designed with solely functionality in mind without consideration to fine taste of art. Other proposed prior art devices have dispensing mechanism design which limits the number of rolls of toilet paper that can be stored in the hopper or magazine. An example of this capacity-limiting design is Davis's U.S. Pat. No. 5,449,127 which has a two-step diameter shaft that is used to manually push to the dispensing position a roll of toilet paper sitting beneath and bearing the weight of the two other rolls of toilet paper above it in the magazine. The friction between the roll of toilet paper being pushed and the one immediately above it increases with the number of rolls of toilet paper that are stacked in the magazine to a point where the frictional force is so great that it will be extremely difficult if not impossible to push the roll of toilet paper at the bottom without causing some damage to the device. It is therefore the intent of this present invention to address and advance solutions to the above cited deficiencies and shortcomings of some prior art devices. The ensuing objects and advantages as well as the summary of the invention describe the unique features of this invention that distinctly distinguish it from the prior art devices.

OBJECTS AND ADVANTAGE

Accordingly, several objects and advantages of my invention combination storage/dispenser for hollow-cored rolled sheet of material such as toilet tissue paper, paper towel, and the like, are as follows:

a) to provide a combination storage/dispenser for toilet tissue paper and other similar hollow-cored roll of paper that is capable of storing an ample supply of said material thus saving cabinet space in a bathroom.

b) to provide a toilet tissue paper roll holder/dispenser that virtually automatically replenishes a used up roll of toilet tissue paper and at the same time disposes its emptied core which falls by gravity into a trash can underneath the device.

c) to provide a toilet tissue paper roll holder/dispenser that automatically performs three events at the same time such as replacing a used up tissue paper roll, disposing the emptied core of said spent toilet tissue paper, and catching a new roll of tissue paper from a hopper for the next replacement when the one in use runs out. Such events are simultaneously accomplished with just one turning of a rotatable carrier of rolls of toilet paper through a specified angle.

d) to provide a toilet tissue paper roll holder/dispenser that saves time and effort that would otherwise be spent in replenishing a used up roll of toilet tissue paper.

e) to provide a toilet tissue paper roll holder/dispenser that projects an image of technical advancement and modernization in bathroom furnishings.

f) to provide a toilet tissue paper roll holder/dispenser that makes replacing a used up roll of toilet tissue paper fun to do and even something to look forward to.

g) to provide a toilet tissue paper roll holder/dispenser that renders a neat and tidy appearance and orderliness in a bathroom.

Further objects and advantages will become apparent from a consideration of the ensuing drawings and description.

DRAWING FIGURES

The drawings, closely related figures have the same number but with different alphabetic suffixes.

FIG. 1A—Shows the front view of the invention.

Figure 1B:
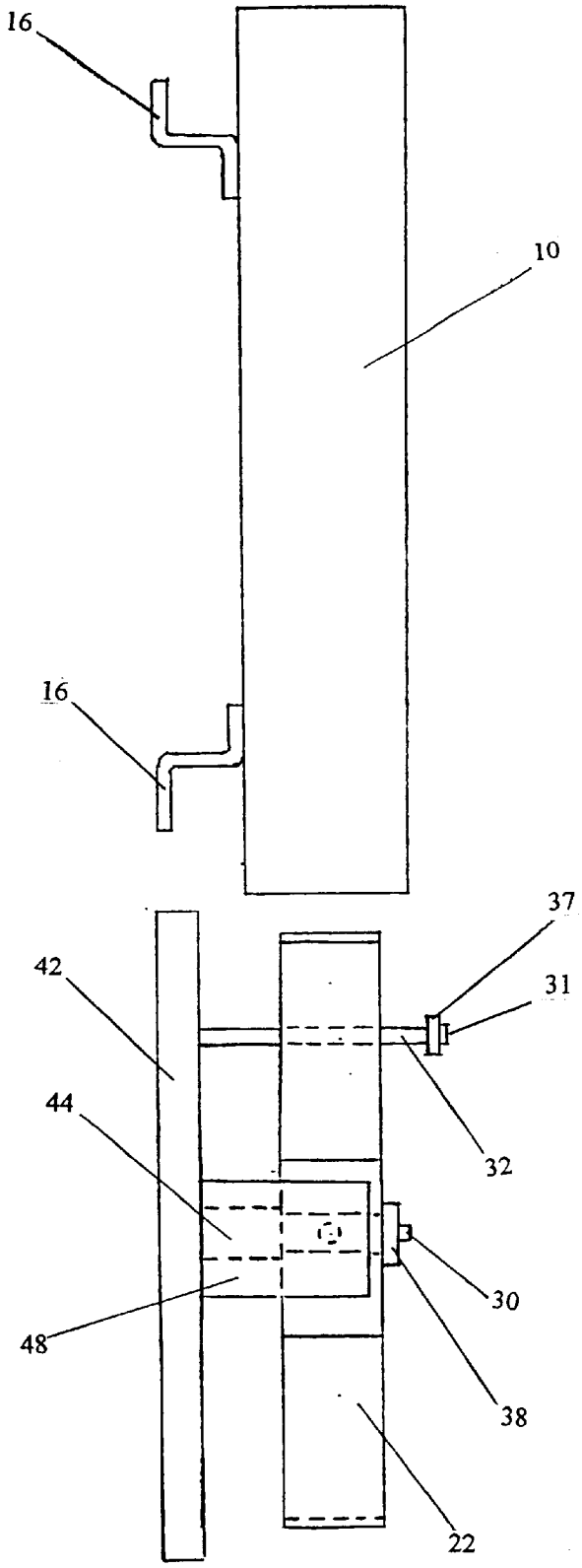

FIG. 1B—Shows the side view of the invention.

Figure 1C:
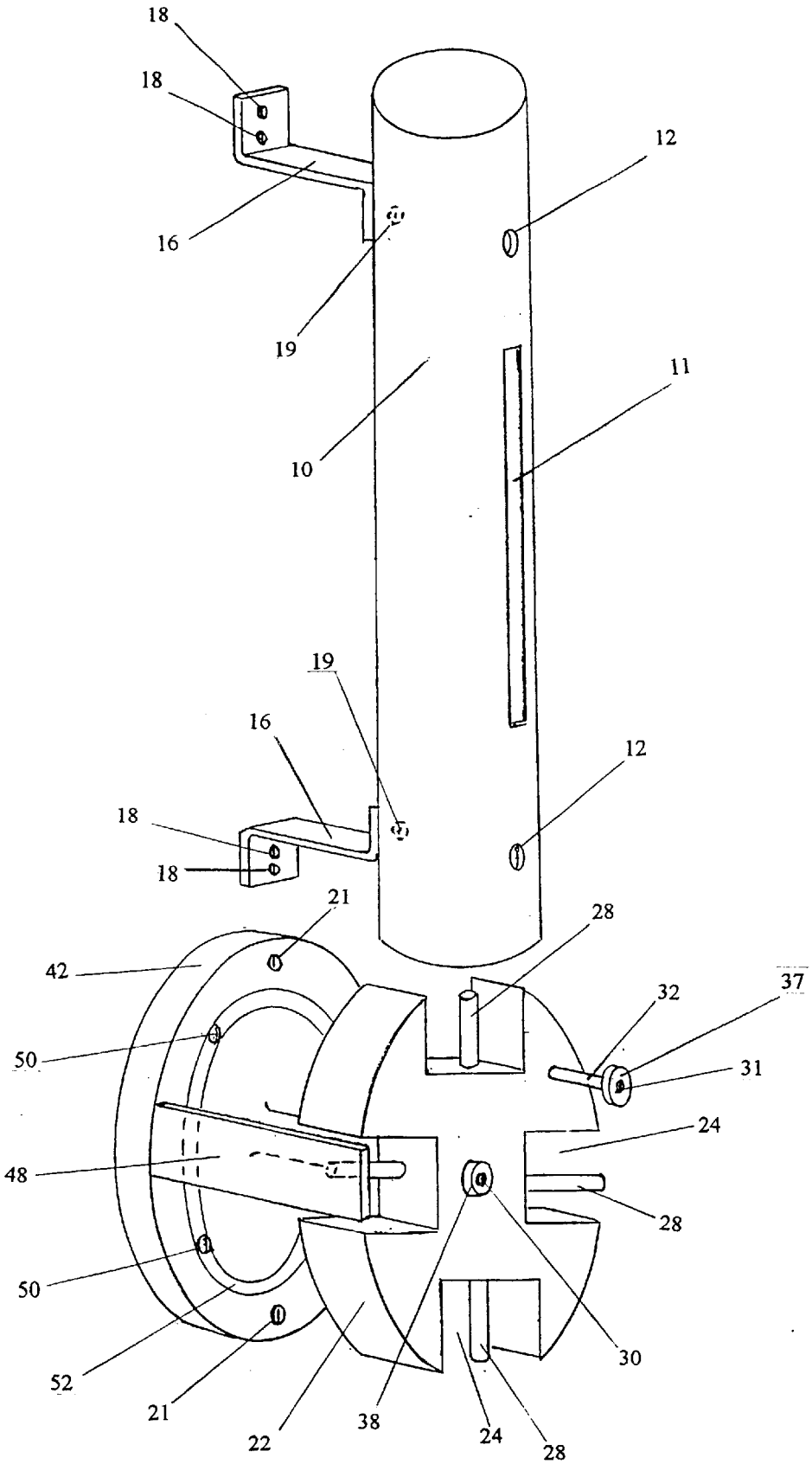

FIG. 1C—Shows the isometric view of the invention.

Figure 1D:
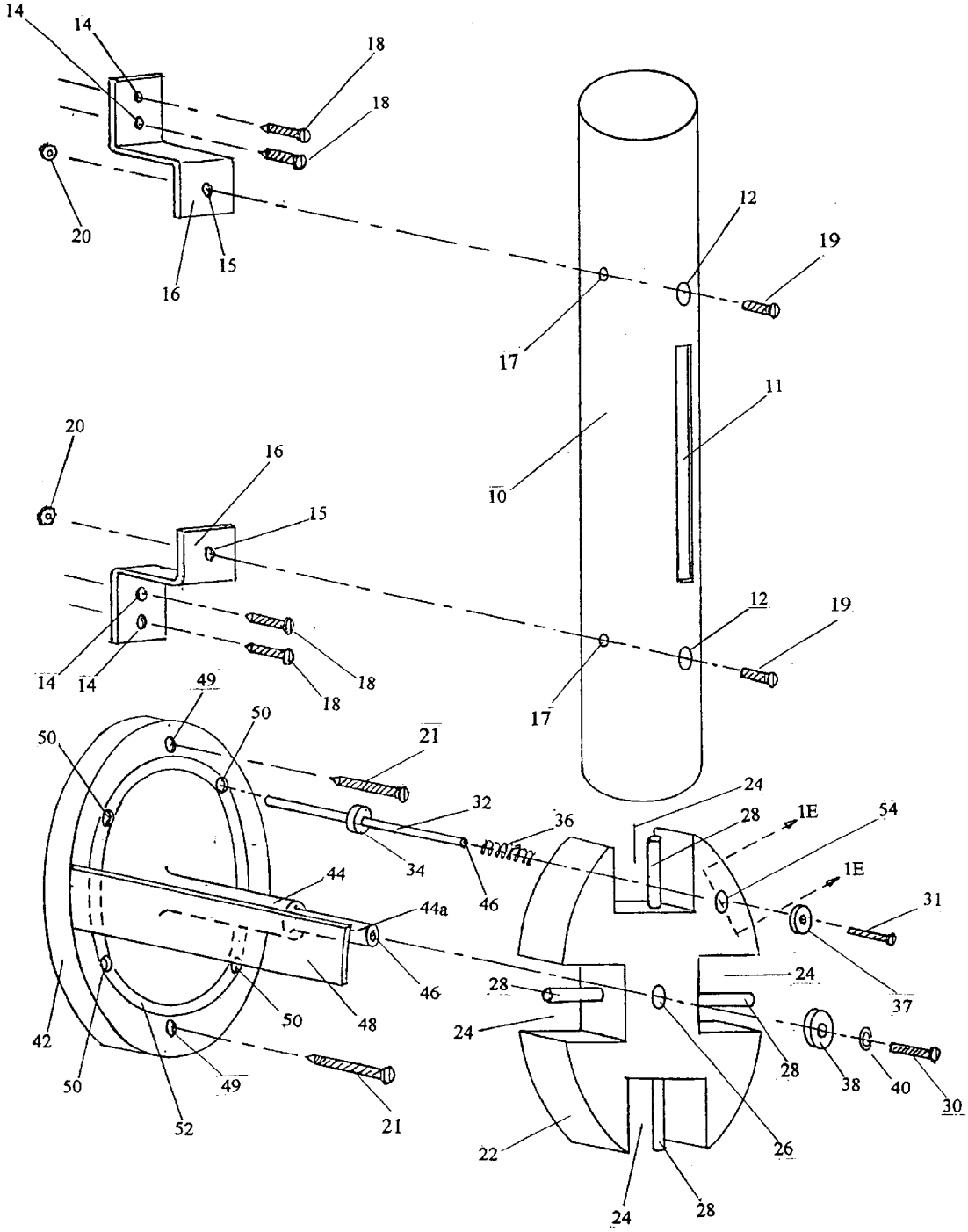

FIG. 1D—Shows the isometric exploded view of the invention.

Figure 1E:
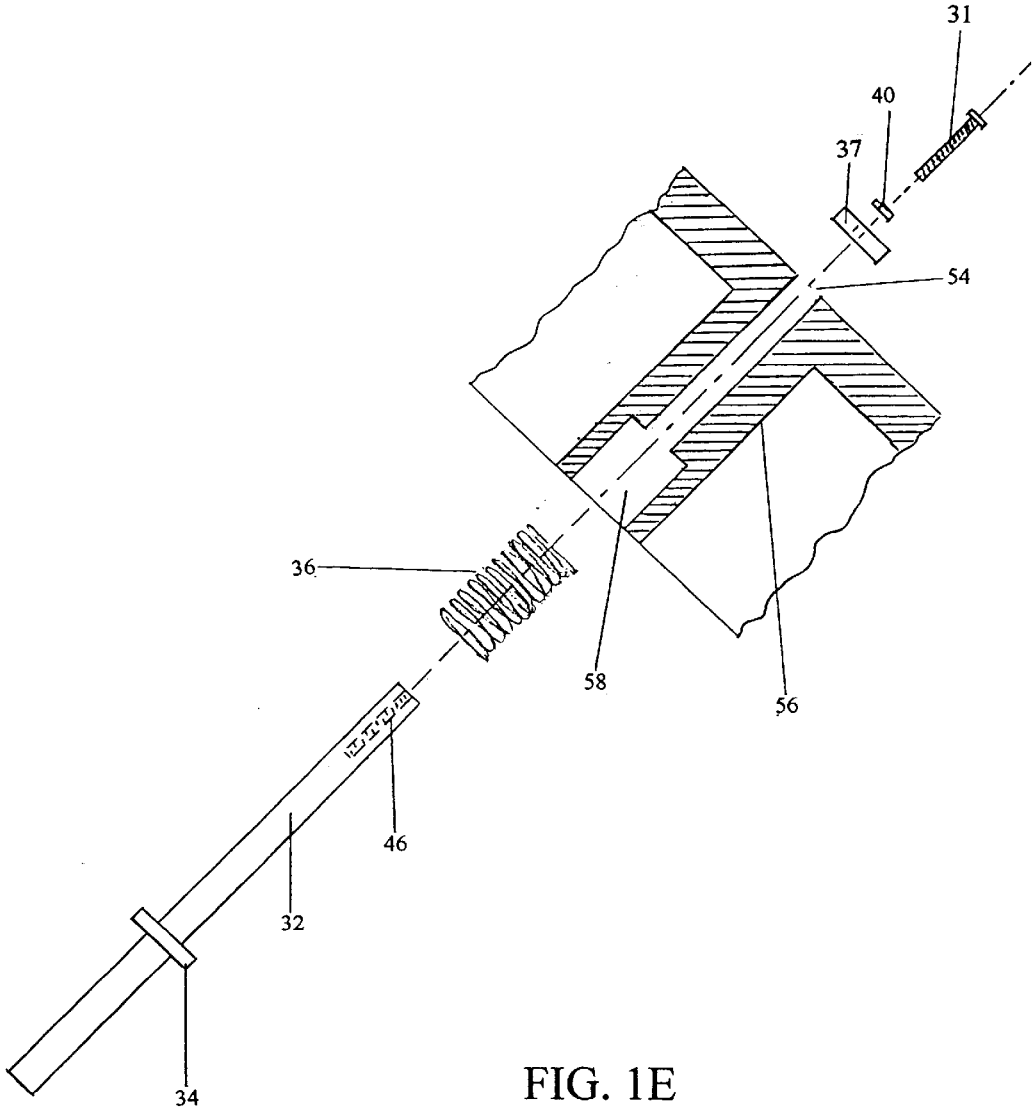

FIG. 1E—Shows the cut-out (sectionalized) view of the sleeve and illustrates the spindle and coil assembly of the invention.

Figure 1F:
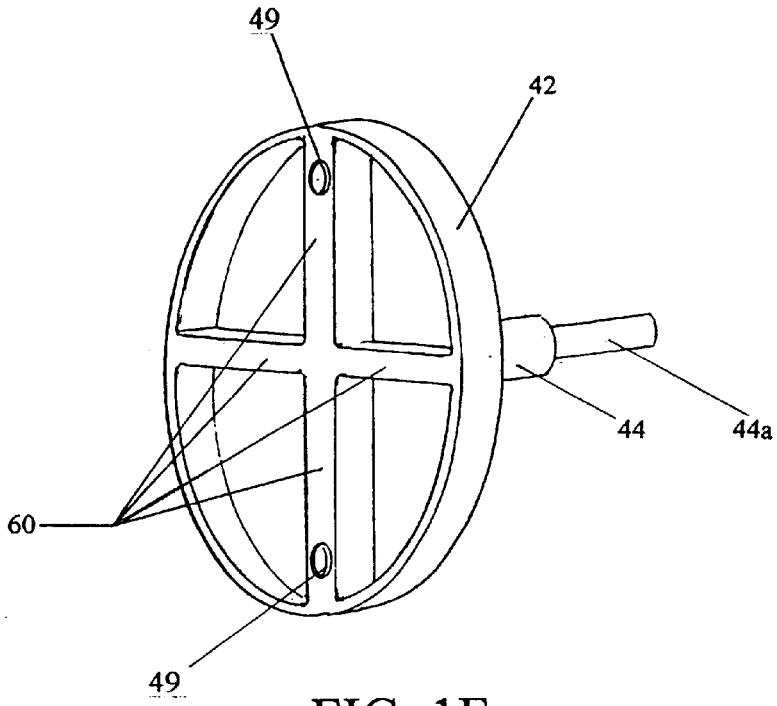

FIG. 1F—Shows the isometric back view of the base of the invention.

Figure 1G:
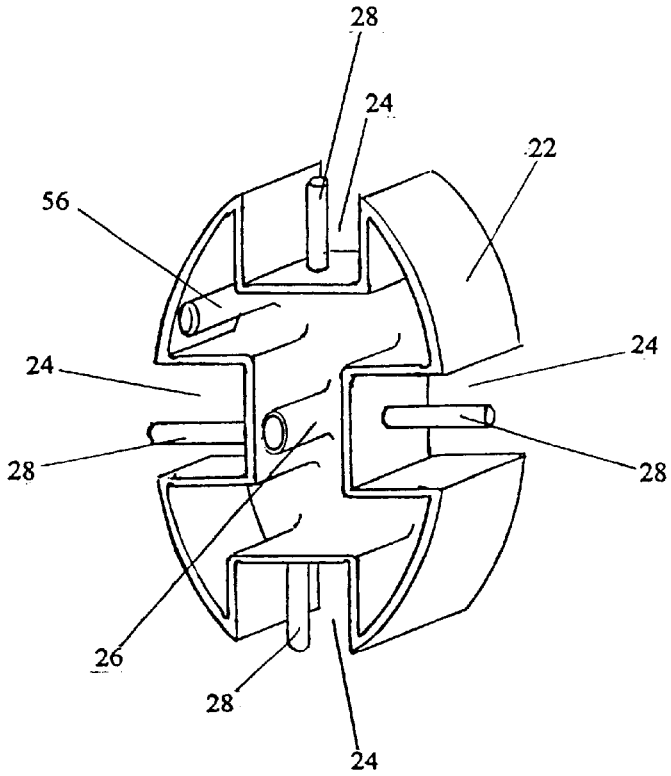

FIG. 1G—Shows the isometric back view of the starwheel of the invention.

Figure 2:
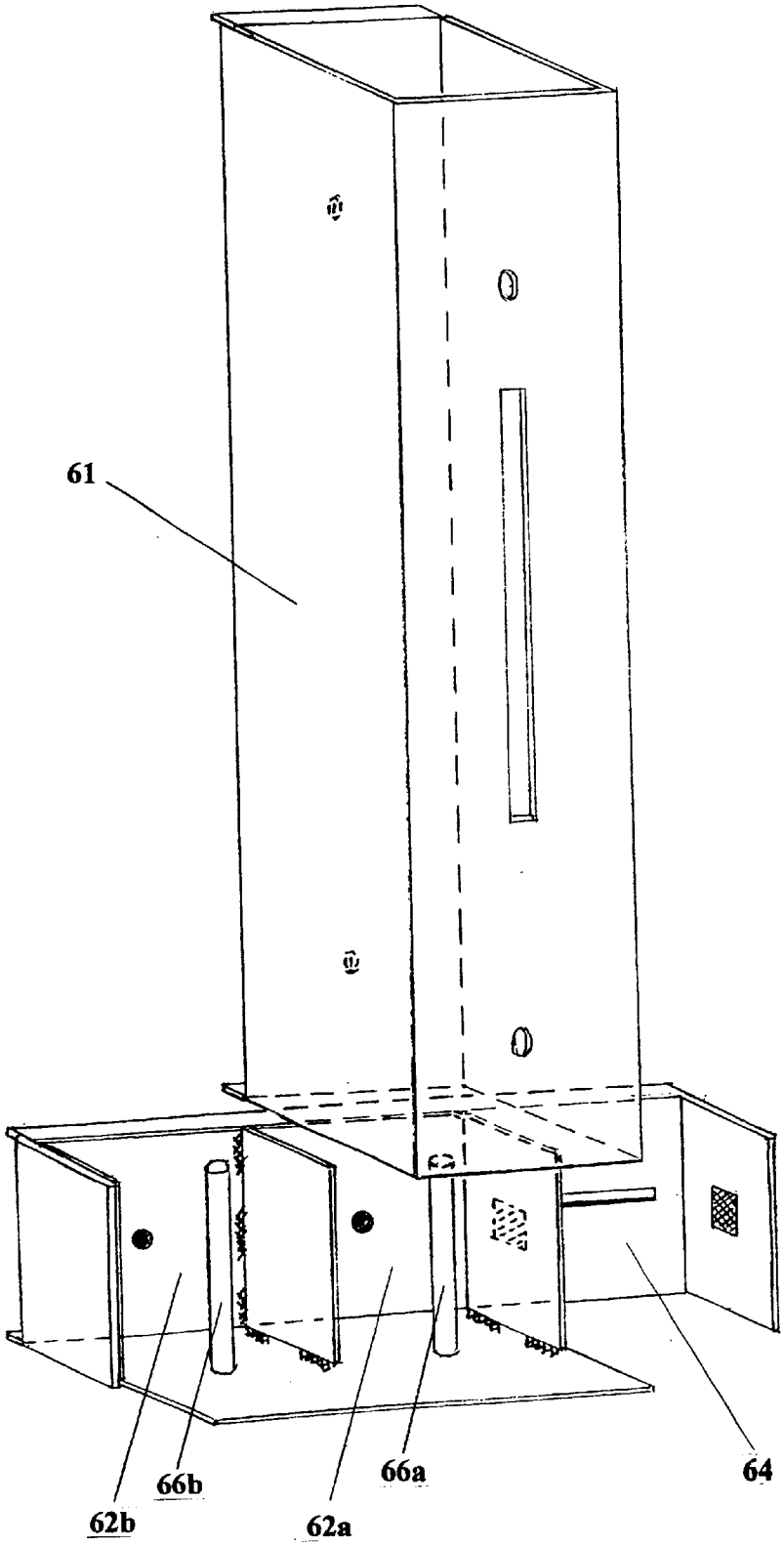

FIG. 2—Shows possible variation (Embodiment II) of the invention.

Figure 3:
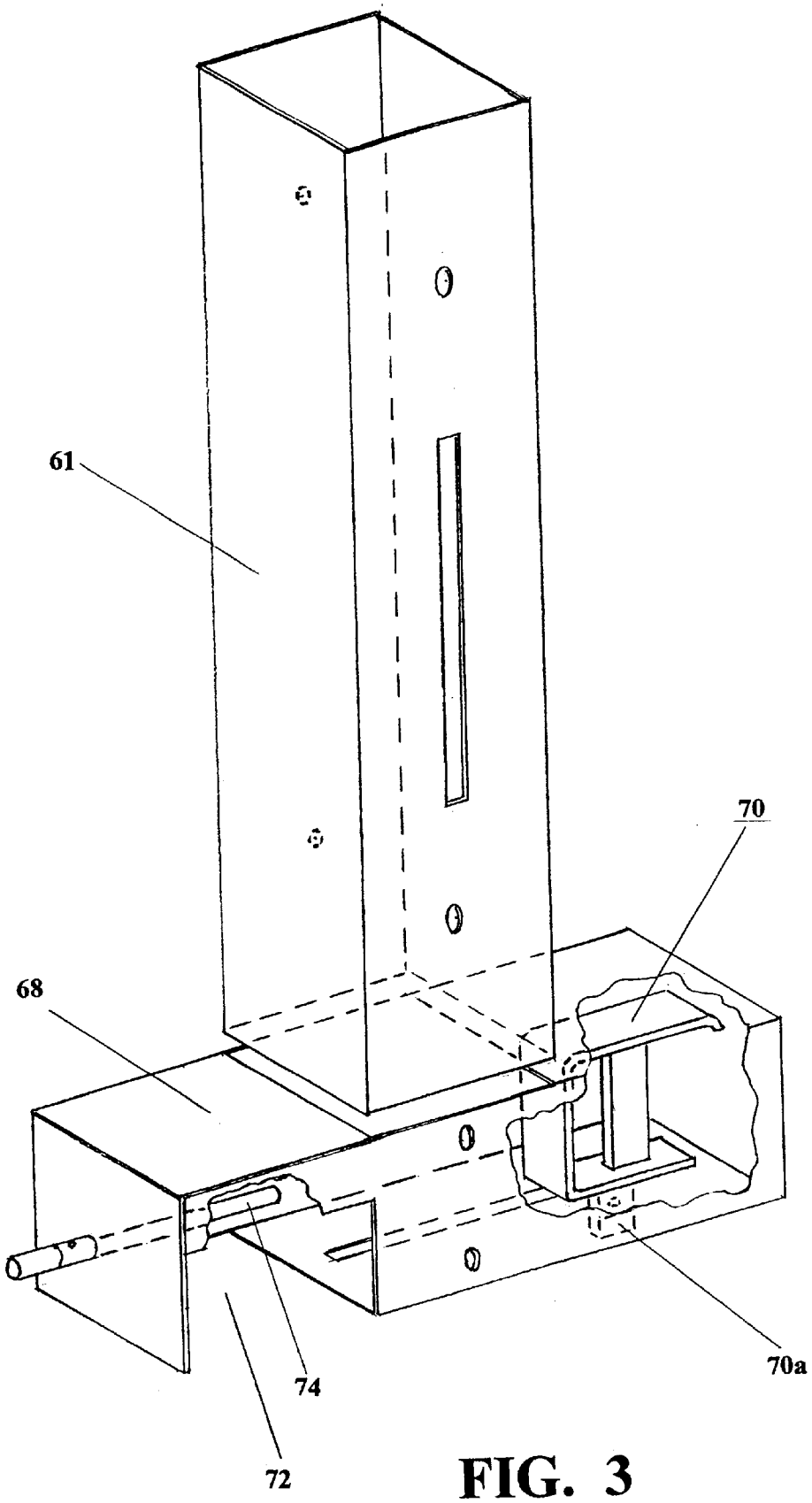

FIG. 3—Shows possible variation (Embodiment III) of the invention.

REFERENCE NUMERALS IN THE DRAWINGS

| | |
|---|---|
| 10 | Hopper |
| 11 | Window |
| 12 | Screw driver clearance holes |
| 14 | Screw clearance holes |
| 15 | Anchor angle plate bolt clearance holes |
| 16 | Anchor angle plates |
| 17 | Hopper bolt clearance holes |
| 18 | Anchor angle plate screws |
| 19 | Anchor angle plate bolts |
| 20 | Nuts |
| 21 | Base screws |
| 22 | Starwheel |
| 24 | Cutouts |
| 26 | Hub |
| 28 | Paper roll holder rods |
| 30 | Shaft bolt |
| 31 | Spindle bolt |
| 32 | Spindle |
| 34 | Collar |
| 36 | Coil Spring |
| 37 | Spindle washer |
| 38 | Shaft washer |
| 40 | Lock washer |
| 42 | Base |
| 44 | Shaft |
| 44a | Shaft extension |
| 46 | Shaft axial threaded hole |
| 48 | Shield |
| 49 | Base mounting holes |
| 50 | Slots |
| 52 | Channels |
| 54 | Bore |
| 56 | Sleeve |
| 58 | Spring housing |
| 60 | Ribs |

SUMMARY OF THE INVENTION

The combination storage/dispenser for rolls of toilet tissue paper of the present invention provides solution to the aforementioned deficiencies and shortcomings of the prior art devices. Said combination storage/dispenser for rolls of toilet tissue paper comprises a cylindrical hopper appropriately dimensioned to hold a plurality of said rolls of toilet paper. A circular base precisely positioned directly below said hopper and having a shaft at its center with a smaller diameter on a certain section of its length starting from the far end extending inwardly along said shaft toward said base for a predetermined length. Said base also has four circular slots of appropriate depth and equally spaced along the periphery of said base near its edge. A channel runs from slot to slot on said base in a circular path, a shield that is as long as said shaft projects from the edge of, and normal to the plane of said base. A starwheel having four appropriately dimensioned cutouts equally spaced around its periphery and each having a toilet paper roll holder rod standing at the bottom side (floor) of each said cutouts. A hub projects from the center of, and at the back side of said starwheel. A sleeve having a bore of specified diameter and length also projects from the back side of, and at a precise location at one quadrant of said starwheel. The diameter of the bore at a certain length at the far end of said sleeve is sufficiently enlarged to house a coil spring. A spindle having a collar which keeps said coil spring from falling off from said spring housing goes through said coil spring in said spring housing and through said bore of said sleeve. The starwheel assembly is mounted on and supported by the smaller-diameter end of the aforesaid shaft which goes through the bore of said starwheel's hub. This arrangement positions said starwheel directly and precisely below said hopper with one of said starwheel's toilet paper holder rods centrally positioned with said hopper's axis and ready to receive a roll of toilet paper from said hopper, and the bottom end of said spindle rests in a slot in a quadrant of the aforesaid base keeping said starwheel firmly in place until the roll of toilet paper in the dispension position is all used up and the starwheel again needs to be rotated to replenish the spent toilet paper, and so the cycle goes on.

The present invention is operated by first loading rolls of toilet paper into the hopper in an orientation that is co-axial with said hopper. Obviously the first roll of toilet paper dropped into said hopper falls right onto a toilet paper holder rod in a cutout of said starwheel. The system is now ready to bring a roll of toilet paper to a dispension position which is either the one on the zero-degree position (FIG. 1A) for counterclockwise-mode operation of the starwheel, or the one on the 180-degree position for counterclockwise-mode operation of said starwheel. To bring a roll of toilet paper to the desired dispension position, pull the spindle up by about a quarter inch to free its bottom end from a slot on the base, manually raise the stack of toilet paper rolls in the hopper and turn the starwheel via said spindle through about five degrees to the direction of the desired dispension position, then let go of the spindle allowing the coil spring to push it down onto the channel on said base, then continue turning the starwheel until the bottom end of said spindle falls (as will be indicated by a click sound) into another slot on said base locking said starwheel in place, then release and let the stack of toilet paper rolls in the hopper drop down with the bottom roll falling right onto a toilet paper holder rod in the next cutout that comes directly under said hopper. The first roll of toilet paper is now ready for dispension by a user at the selected dispension position. When said first roll of toilet paper has been all used up, it will be replaced by simply turning the starwheel as described above. Note that with just one 90-degree turning of said starwheel to replace the spent roll of toilet paper, three events simultaneously take place, i.., the tube of the spent toilet paper falls off from the toilet paper roll holder rod by gravity into a trash can underneath the device, a fresh new roll is brought to the dispension position ready for use, and a third replacement roll drops by gravity from said hopper onto a toilet paper holder rod in a cutout of said starwheel—a practically automatic operation.

Further description of the unique features, configuration, and advantages of the present invention over the prior art will be apparent in the remaining text of the specification and the ensuing claims.

Description of the Preferred Embodiment of the Invention

The inventor's most preferred embodiment of this invention combination storage/dispenser for hollow-cored rolled sheet of material, specifically toilet tissue paper, paper towel, and similar commodities, is depicted in FIG. 1A (front view), FIG. 1B (side view), FIG. 1C (isometric view), and FIG. 1D (isometric exploded view). Said combination storage/dispenser for toilet paper comprises a hopper 10 of appropriate length and diameter and having a cylindrical or rectangular cross section and appropriately dimensioned to hold a certain quantity of toilet paper rolls. Said hopper 10 is open-ended and has two screw driver clearance holes 12 on its front side, and corresponding two bolt clearance holes 17 on its back side to facilitate mounting it on a pair of anchor angle plates 16 (better seen in FIG. 1B) behind it with bolts 19 (FIG. 1D). Hopper 10 also has a long narrow window 11 (optional) on its front side which facilitates visual inspection of, and access to said toilet paper rolls inside said hopper 10.

Anchor angle plates 16 each has a bolt clearance hole 15 (better seen in FIG. 1D) through which said hopper 10 is bolted with bolt 19 and secured by nut 20 to said anchor angle plates 16, and two screw clearance holes 14 which facilitate mounting said anchor angle plate 16, and hence said hopper 10 to a bathroom wall with screws 18.

Still looking at FIG. 1D, a circular base 42 has a shaft 44 projecting from its center and normally to its plane. Said shaft 44 has an extension 44*a* of certain length with a reduced diameter and an axially threaded hole 46 at its end. Base 42 also has four circular slots 50 of appropriate depth, and equally spaced around said shaft 44 near the edge of said base 42. A channel 52 runs from slot 50 to slot 50 on said base 42 in a circular path. A shield 48 projects from the edge of, and normal to the plane of said base 42. Said shield 48 is as long as, and parallel to said shaft 44. Base 42 also has two clearance holes 49 to facilitate mounting it with screws 21 on a bathroom wall in a precise position below said hopper 10. Ribs 60 (FIG. 1F) provide strength which preclude buckling of said base 42. It is herein emphasized that the above described method of mounting the device of this invention on a bathroom wall with the use of anchor angle plates 16 and circular base 42 as depicted on the drawings and described above, should not be construed as limitations on the scope of the invention, but rather as an exemplification of one preferred embodiment thereof.

A starwheel 22 (FIG. 1A) having four cutouts 24 equally spaced around its periphery are precisely dimensioned to accommodate a fairly wide range of toilet paper roll sizes. A toilet paper roll holder rod 28 stands at the bottom side (floor) of each of said cutout 24 closer to the right-hand side wall of said cutout 24. This is so designed as to allow a roll of toilet paper to hang freely from said toilet paper holder rod 28 without touching the opposite side wall of said cutout 24 when it is in the dispension position at the 180-degree position (FIG. 1A) facilitating easy and smooth unrolling of the toilet paper when needed. This design consideration may also be effected by making the opening of each of said cutouts 24 sufficiently wide and locating a toilet paper holder rod 28 at the center of the bottom side (floor) of each of said cutout 24 permitting a roll of toilet paper to hang freely from said holder rod 28 without touching either side wall of said cutout 24 whether it is in the 0-degree or 180-degree dispension position. Such design would allow operation of said starwheel 22 in either clockwise-mode or counterclockwise-mode of rotation. In such a case, a second shield 48*a* would also have to be provided at the other side of said base 42 displaced at 180 degrees from the first shield 48. A hub 26 (better seen in FIG. 1G) projecting from the center of, and at the back side of said starwheel 22 receives said shaft extension 44*a* (FIG. 1D) which supports said starwheel 22 in precise position below said hopper 10. Said shaft extension 44*a* slightly protrudes on the face side of said starwheel 22. A washer 38 is bolted with bolt 30 through a lock washer 40 to a threaded hole 46 at the end of said shaft extension 44*a*. Said washer 38 keeps said starwheel 22 in its precise position on said shaft extension 44*a*. A sleeve 56 (better seen in FIG. 1G) projects from the back side of starwheel 22 to a height equal to the width of said starwheel 22. Looking at FIG. 1E, said sleeve 56 has a bore 54 and a spring housing 58. A coil spring 36 is housed in said spring housing 58 of said sleeve 56. A spindle 32 having a collar 34 which keeps said coil spring 36 from falling off from said spring housing 58, goes through said coil spring 36 in said spring housing 58 and through said bore 54 of said sleeve 56. A washer 37 bolted with bolt 31 to a threaded hole 46 at the end of said spindle 32 protrudes beyond the face side of said starwheel 22 (see also FIG. 1C for protruding spindle 32).

Materials

Hopper 10 and its anchor angle plates 16 of this preferred embodiment of the invention combination storage/dispenser for toilet paper are made of plexiglass and aluminum materials respectively. However, said component parts of this combination storage/dispenser for toilet paper rolls may be made of other materials such as PVC, fiberglass, lexan, copper, wood, etc. and any appropriate combination thereof. Starwheel 22 and its base 42 of the invention are made of PVC material. Similarly, they can also be made of other materials such as lexan, delrin, fiberglass, aluminum, copper, stainless steel, and other metals, wood, chipboard, etc. However, due to the configuration of starwheel 22, it will be cost effective to use moldable materials such as PVC, lexan, etc as opposed to fabricating piece parts of non-moldable materials to be assembled together to build starwheel 22.

Shape

Hopper 10 of the invention has a cylindrical cross section. It could have a rectangular cross section and will still be functional. However, since the rolls of toilet paper will be loaded into said hopper 10 in an orientation co-axially with said hopper 10, obviously it is preferable for hopper 10 to have a cylindrical cross section as such shape conforms to the diameter of toilet paper rolls and affords an enhanced appearance.

Dimensions

Hopper 10 of the invention combination storage/dispenser for toilet paper rolls has an inside diameter of approximately 5 inches and a length of about 24 inches. Starwheel 22 has a diameter of roughly 17 inches and a width of about 3 inches. A cutout 24 of said starwheel 22 is roughly 7 inches wide by 4 inches deep. Base 42 has a diameter of approximately 18 inches and a width of about 1½ inches. Wall thickness of starwheel 22 and base 42 is 0.200 inch to 0.250 inch. Shaft 44 of base 42 has a diameter of approximately 1¾ inches on about 1½ inches of its length near the surface of said base 42, which drops down to a diameter of about 1 inch on the remaining length of about 3 inches at its end where said starwheel 22 is supported.

Above stated dimensions of the various components of the invention combination storage/dispenser for toilet paper rolls are only intended to give the reader an idea of the approximate physical size of said various component parts of the invention and of the unit as a whole and should not therefore be construed as limitations of the scope of this invention. The dimensions of some or all of the component parts and therefore of the unit as a whole of this invention, may be changed or varied to suit space limitations at the point of use.

Production

FIG. 1D shows the isometric exploded view of this invention combination storage/dispenser for toilet paper rolls. It can be seen from said exploded view of the invention how, after the various component parts have been individually fabricated or manufactured to specified shapes and dimensions, said component parts can be assembled together into a complete working unit as shown in FIG. 1C (isometric view). The component parts of said invention may be manufactured from any of the various materials mentioned above, or any appropriate combination thereof. To illustrate a method of manufacturing the combination storage/dispenser for toilet paper rolls, use of lexan for hopper 10, aluminum for anchor angle plates 16, PVC for base 42 and starwheel 22, and delrin for the toilet paper holder rod 28 will be assumed. Hopper 10 will be cut from a purchased Lexan tubing stock of required diameter and wall thickness. Two screw driver clearance holes 12 will be drilled on the front side of said hopper 10 and two corresponding bolt clearance holes 17 will be drilled at the back side of said hopper 10. Two pieces of required length of anchor angle plates 16 will be cut from a purchased aluminum flat bar stock having the required width and thickness. Two screw clearance holes 14 and one bolt clearance hole 15 will be drilled at specified locations on each of said cut aluminum flat bar, and then it is machine-formed in a brake press to specified configuration of said anchor angle plate 16. Specified length of toilet paper holder rod 28 will be cut from a purchased length of delrin stock of required diameter. Tooling molds built from given engineering drawings of component parts starwheel 22 and base 42 will be used to produce said component parts to their specified configuration by injection molding process using PVC material. The injection-molded starwheel 22 and base 42 then go through deflashing (if needed), cleaning, and inspection operations. Washers, coil spring, screws, and nuts are purchased to specifications. The component parts are now complete and are ready to be assembled into a complete working unit of the invention as depicted on FIG. 1C.

Other Methods

There are other methods or processes that may be employed to make said combination storage/dispenser for toilet paper rolls of the invention such as fabricating individually the many piece parts that make up said starwheel 22 and assemble them together into a completed component such as said starwheel 22. However, as mentioned above, due to the configuration of said starwheel 22, injection molding is far more cost effective and therefore the most preferred method of manufacturing this invention.

Operation of the Preferred Embodiment of the Invention

To put this invention combination storage/dispenser for toilet paper in operation, mount per installation instructions provided, a completed unit on a wall in a bathroom near a toilet bowl such that it is within reach of a human sitting on the toilet bowl seat.

Load in vertical orientation rolls of toilet paper one at a time into hopper 10 (FIG. 1A) through the opening at its top end until it is full. The first roll dropped into said hopper 10 will go straight down into a cutout 24 of starwheel 22 where it will be held in place by toilet paper holder rod 28. To put said first roll of toilet paper in position ready for use, grasp with one hand the roll of toilet paper sitting on top of the first roll dropped into hopper 10 which is now in said cutout 24 of said starwheel 22 and raise said toilet paper roll held by said one hand up by about two inches thereby raising the column of toilet paper rolls stacked in said hopper 10 above it. Then with the other hand, hold and pull washer 37 and hence spindle 32 about quarter inch up to get the bottom end of said spindle 32 out of a slot 50 on the surface of base 42, and turn said starwheel via said spindle 32 counterclockwise initially through an arc of about 5 to 10 degrees, then let go of the spindle 32 so that coil spring 36 pushes it down onto channel 52 that runs from slot 50 to slot 50 on the top surface of base 42. Then re-grasp washer 37 and resume turning said starwheel counterclockwise until the bottom end of said spindle 32 which is travelling in and being guided by said channel 52, reaches and falls into another slot 50 (as indicated by a click sound) which is 90 degrees from the other slot 50 where said spindle 32 just came from. At this instant, the first roll of toilet paper is at 180-degree position (FIG. 1A) ready for use, and the next roll of toilet paper has just fallen from said hopper 10 down into the next cutout 24 at the 90-degree position where it is held in place by aforesaid toilet paper roll holder rod 28

As said first roll of toilet paper in the 180-degree position (dispension point) is being used, it is shielded and prevented from falling off from said holder rod 28 by shield 48. In due time, said first roll of toilet paper in the 180-degree position will be all used up. To replenish said spent roll of toilet paper, bring the second roll of toilet paper that is in the 90-degree position under said hopper 10 to the 180-degree position by again turning said starwheel 22 in the same manner as described above. By so doing, the emptied hollow cardboard core of the spent toilet paper is automatically discarded as it falls by gravity into a trash can underneath the device even before the new roll of toilet paper reaches the dispension position at the 180-degree position. Said second roll of toilet paper from the 90-degree position now reaches the 180-degree position (dispension point) and ready for use, while a third roll of toilet paper falls down by gravity from said hopper 10 into another cutout 24 that just arrived at the 90-degree position where said third roll is held in place by another holder rod 28.

Again in due time, the roll of toilet paper in the 180-degree position (dispension point) will be all used up. To discard the emptied hollow cardboard tube of said spent toilet paper, and at the same time replenish it with a new roll of toilet paper, repeat the cycle again by turning said starwheel 22 exactly the same manner as described above. Note that with just one 90-degree turn of said starwheel 22 to replace the spent toilet paper, three events simultaneously take place i.e., the hollow cardboard tube of the spent toilet paper falls off from said toilet paper roll holder rod 28 by gravity into a trash can below the device, a fresh new roll is brought to the dispension position ready for use, and a third replacement roll of toilet paper drops from said hopper 10 onto a holder rod 28 in a cutout of said starwheel 22—a pratically automatic operation.

In due time, the stack of rolls of toilet paper in said hopper 10 will be all used up, so when only one or two rolls of toilet paper are left in hopper 10, re-load it with new rolls of toilet tissue paper in the same manner described at the beginning of this description of operation of this invention.

Starwheel 22 can also be operated in the opposite direction, that is, it can be rotated in clockwise direction and still function in exactly the same way as when it is rotated in counterclockwise direction as described above. This flexibility may be accomplished by one of the following ways: 1) Make a starwheel 22 with a paper roll holder rod 28 closer to the left-hand side of cutout 24 so that when said starwheel 22 is rotated clockwise through 90-degree angle, a roll of toilet paper will be at the 0-degree position (dispension point) see FIG. 1A, hanging freely on said toilet paper holder rod 28 without touching the right-hand side wall of said cutout 24 facilitating easy and smooth unrolling of tissue paper when needed.

2) Make a starwheel 22 with two threaded holes at the bottom side (floor) of said cutout 24 of said starwheel 22. One of said two threaded holes is closer to the left-hand side wall of said cutout 24, and the other threaded hole being closer to the right-hand side wall of said cutout 24. Make toilet paper holder rods 28 having one end threaded which matches the threads in the two threaded holes at the bottom side (floor) of said cutout 24.

When it is desired to operate the device on a countclockwise-mode rotation of said starwheel 22, said holder rod 28 should be screwed into the threaded hole at the bottom side (floor) of said cutout 24 that is closer to the right-hand side wall of said cutout 24. If a clockwise-mode of rotation of said starwheel 22 is desired, said paper roll holder rod 28 should be screwed into the threaded hole at the bottom of said cutout 24 that is closer to the left-hand side wall of said cutout 24. When either of the above modes of rotation of said starwheel 22 is selected, said hopper 10 and base 42 (FIG. 1A) should be mounted on a bathroom wall such that said paper roll holder rod 28 of said starwheel 22 aligns co-axially with said hopper so that a toilet paper roll falling down from said hopper 10 will be properly positioned in a cutout 24 of said starwheel 22. Such flexibility affords some advantage in that said starwheel 22 may be rotated clockwise of counterclockwise whichever way will display a roll of toilet paper closer to the user.

3) Make a starwheel 22 having cutouts 24 with sufficiently wide opening and locate said toilet paper roll holder rod 28 at the center of the bottom side (floor) of said cutout 24 permitting a roll of toilet paper to hang freely on said holder rod 28 without touching either side of said cutout 24 whether it is in the 0-degree or 180-degree position (dispension point) see FIG. 1A facilitating easy and smooth unrolling of toilet paper from a roll. With this design, a second shield 48*a* would have to be provided on the other side of said base displaced 180 degrees from the first shield 48. This arrangement therefore allows clockwise or counterclockwise rotation of said starwheel 22.

CONCLUSION, RAMIFICATIONS, AND SCOPE OF THE INVENTION

Accordingly, the reader will see that the combination storage/dispenser for rolls of toilet paper of this invention can be used extremely efficiently and with utmost convenience for a virtually automatic dispensing of said toilet paper. Additionally, said combination storage/dispenser for toilet paper facilitates storage of an ample supply of rolls of toilet paper in its hopper ready for automatic feeding upon demand, into its dispensing mechanism such as the starwheel. Further advantages of this invention are as follows:

a) With just one 90-degree turning of said starwheel to replace a spent roll of toilet paper, three events simultaneously take place i.e., the emptied hollow cardboard core of the spent toilet paper falls off from the toilet paper roll holder rod by gravity into a trash can underneath the device, a fresh new roll of toilet paper is brought to the dispension position ready for use, and a third replacement roll of toilet paper drops by gravity from the hopper onto a toilet paper roll holder rod in a cutout of said starwheel—a practically automatic operation.

b) The combination storage/dispenser for toilet paper of this invention saves cabinet space in a bathroom since adequate supply of rolls of toilet paper is loaded into said hopper for automatic feeding when needed, into a dispensing mechanism such as the starwheel.

c) The combination storage/dispenser for toilet paper of this invention saves time that would otherwise be spent in manually discarding an emptied core of the spent toilet paper, and replenishing it with a fresh roll from said hopper above said starwheel.

d) The combination storage/dispenser for toilet paper of this invention projects an image of technical advancement and modernization in bathroom furnishings.

e) The combination storage/dispenser for toilet paper of this invention renders a neat and tidy appearance and orderliness in a bathroom.

Although the above description cites many specificities, these should not be construed as limitations on the scope of the invention, but rather as an exemplification of one preferred embodiment thereof. There are possible variations of said preferred embodiment of this invention. For example, there may be a number of cutouts around the periphery of said starwheel instead of four as described above. Said starwheel may have any desired number of spindles and correspondingly, the base may have only one slot, or said starwheel may have one spindle and said base having any desired number of slots. The starwheel may have two threaded holes at the bottom side (floor) of its cutouts where a toilet paper roll holder rod may be alternatively installed to facilitate flexibility of rotating said starwheel in either clockwise or counterclockwise direction and still allows smooth unrolling of a sheet of material from a roll of toilet paper without the roll touching either side wall of said cutout, or the width of said cutout opening may be made sufficiently wide to permit locating said toilet paper roll holder rod at the center of said cutout such that a roll of toilet paper can hang from said toilet paper roll holder rod without touching either side wall of said cutout thereby allowing easy and smooth unrolling of a sheet of material from a roll of toilet paper whether the starwheel is operated in a clockwise mode or counterclockwise-mode of rotation. The starwheel may take a different shape such as just a round wheel without cutouts on its periphery and having only toilet paper roll holder rods standing at spaced locations around its periphery, or just a square box having toilet paper roll holder rod on each of its four peripheral sides. Furthermore, the indexing of said starwheel may be accomplished by some other mechanical, electrical, or electronic arrangement instead of spring loaded spindle-and-slot combination as described above.

Further possible variation of this embodiment of the invention combination storage/dispenser for toilet paper consists of an entirely differently configured dispensing mechanism from a rotatable concept such as the starwheel to a slider dispensing mechanism as depicted in FIG. 2 wherein a slider 62 is mounted on, and can translationally be moved back and forth on a base 64, and having two compartments 62*a* and 62*b* each of which has a toilet paper holder rod centrally located on its floor. When rolls of toilet paper are loaded into hopper 61 above said slider 62, compartment 62*a* is directly underneath said hopper. The first roll of toilet paper dropped into said hopper 61 will fall straight down into compartment 62*a* where it will be held in place by toilet paper roll holder rod 66*a*. To display said first roll of toilet paper for use, grasp with one hand the roll of toilet paper that is still at the discharge end of said hopper 61 and sitting on top of said first roll, and raise it by about two inches thereby raising the entire column of toilet paper rolls stacked in said hopper 61, then hold the slider 62 with the other hand and slide it to the right-hand end of said base 64 where said first roll of toilet paper will be ready for dispension by a user, at which point in time, compartment 62*b* will be directly under said hopper 61, then let go and release the stack of toilet paper rolls in said hopper thereby allowing a second roll to fall straight down into compartment 62*b* ready for the next replacement. When said first roll of toilet paper in compartment 62*a* has all been used up, remove the emptied cardboard core of the spent toilet paper and slide said slider 62 (in the way it was moved to the right-hand end of said base) to the left-hand end of said base 64 to display said second roll of toilet paper for use at the dispension point at that end of said base 64. Said second roll of toilet paper is now ready for dispension by a user, and so the cycle goes on.

Still another possible variation of this invention combination storage/dispenser for toilet paper consists of an entirely differently configured dispenser mechanism from a rotatable concept such as said starwheel to a feeder chamber 68 with a toilet roll pusher 70 within it as depicted in FIG. 3. When the hopper 61 is loaded with rolls of toilet paper, the first roll dropped into said hopper falls right onto and sits on the floor of said feeder chamber 68. To move said first roll of toilet paper to the dispension position at the discharge opening 72 of said feeder chamber 68, where a toilet paper roll holder rod is located to receive a roll of toilet paper, a user would simply hold said toilet paper roll pusher handle 70*a* that is protruding at the bottom side of said feeder chamber 68, and slide said toilet paper roll pusher 70 via sand handle 70*a* toward said discharge hole 72 until said first roll of toilet paper is completely positioned on, and supported by said toilet paper roll holder rod 74 from which said first roll freely hangs and ready for dispension by a user. The user then slides said toilet paper roll pusher 70 back to its original position and as it goes past under the bottom end of said hopper 61, a second roll of toilet paper drops by gravity down onto the floor of said feeder chamber 68 ready for replacement of the first roll for the next cycle. At this point in time, said toilet paper pusher 70 is back and sitting in its original position at the right-hand end of said feeder chamber 68 ready to push said second roll of toilet paper to the dispension position when needed, and so the cycle goes on.

Anyone skilled in the art will acknowledge the fact that the preferred embodiment of the invention disclosed herein can occur in various forms, shapes, and detail without deviating from the true essence and spirit of the invention. Accordingly, the scope of this invention should be determined by the appended claims and their legal equivalents rather than by the embodiments described herein.

I claim:

1. A combination storage/dispenser for hollow-cored rolled sheet of material such as toilet tissue paper, paper towel, and similar commodities, said device being comprised of:

an elongated container having a pre-determined cross-sectional shape and appropriately dimensioned to hold a plurality of rolls of toilet tissue paper, or paper towel, or similar commodities, stacked in such an orientation as to be co-axial with said container;

a pair of anchor angle plates which are bent at 90-degree angle at two places forming a letter almost resembling a letter Z, and each having a plurality of thru screw clearance holes for and a thru bolt clearance hole for;

a base having a pre-determined cross-sectional shape and having a shaft projecting from its center normally to its plane, said shaft having a smaller diameter on a certain section of its length starting from its far end extending inwardly along said shaft toward said base for a pre-determined length and including an axially threaded hole at said far end of said shaft, and a shield projecting from an edge of said base normally to its plane and parallel to and of the same height as said shaft, and a plurality of circular slots of certain depth and equally spaced along circular path near the edge of said base and having a continuous channel of proper depth joining said slots, and a plurality of thru screw clearance holes equidistantly located near the edge of said base;

a rotatable carrier having a pre-determined cross-sectional shape and having a plurality of cutouts along its periphery which are each appropriately dimensioned to accommodate a wide range of toilet paper roll sizes, each of said cutout having a plurality of threaded holes at its bottom side(floor), one of said holes is closer to the right-hand side wall of said cutout and the other one of said holes is closer to the left-hand side wall of said cutout, and a plurality of toilet paper roll holder rods each having first and second opposite ends with the first end having threads of certain length, and one of said toilet paper roll holder rods is threaded correspondingly into one of the threaded holes at said bottom side (floor) of each of said cutouts, and a hub projecting at the back side of and normally to the plane of said rotatable carrier and having a length equal to the width of said rotatable carrier, and a sleeve projecting at the back side of and normally to the plane of said rotatable carrier having a length equal to the width of said rotatable carrier and having a bore of certain diameter which terminates at an enlarged diameter bore at its far end which serves as a housing for a coil spring;

a coil spring of specified diameter and length adapted to be received and housed in said enlarged-diameter portion of said bore at the terminal end of said sleeve;

a spindle having a specified length and diameter and having a circular collar located on a precise location somewhere along the length of said spindle and further having an axially threaded hole at its end.

2. The elongated container of claim 1 is a hopper having a cylindrical cross section of specified diameter and a length sufficient to hold a stack of plurality of toilet paper rolls and having an elongated window for visual inspection of, and access to the rolls of toilet paper inside said hopper.

3. The hopper of claim 2 is mounted on a pair of anchor angle plates of claim 1 with bolts which in turn are mounted on a bathroom wall with screws.

4. The base of claim 1 wherein said plurality of thru clearance holes serve as mounting holes for mounting said base with screws directly and precisely below said hopper of claim 2 on a bathroom wall proximate a toilet bowl.

5. The base of claim 1 wherein said smaller-diameter section of said shaft is precisely dimensioned and adapted to go through the bore of said hub of said rotatable carrier of claim 1 to support said rotatable carrier directly and precisely below said hopper of claim 2.

6. The base of claim 1 wherein said shield stops and prevents a roll of toilet paper from falling off from a toilet paper roll holder rod while a user is unrolling a sheet of toilet paper from said roll at the dispension point.

7. The base of claim 1 wherein said shield projecting from the edge at the left side of said base preventing a roll of toilet paper from falling from said toilet paper roll holder rod at the dispension point facilitates rotation of said rotatable carrier in one sense only i.e., counterclockwise direction. Another similar shield would have to be provided at the other side of said base at a location displaced at 180 degrees from said shield at the left side of said base to permit rotating said rotatable carrier in either sense i.e., counterclockwise or clockwise direction.

8. The base of claim 1 wherein said plurality of circular slots are 90 degrees apart and having a specified depth into which the bottom end of said spindle periodically falls and stays when said rotatable carrier is operated to perform its intended function in a cyclic fashion. Said circular slots therefore, in conjunction with the spring-loaded spindle facilitate indexed rotation of said rotatable carrier.

9. The rotatable carrier of claim 1 is a starwheel wherein said plurality of threaded holes at the bottom side (floor) of each said cutouts are intended by design, to facilitate rotation of said starwheel in either clockwise or counterclockwise direction during operation without the roll of toilet paper in the dispension position touching either one of the side walls of said cutout when said toilet paper roll holder rods are installed into properly corresponding holes at the bottom side (floor) of said cutouts allowing a free and smooth unrolling of a sheet of toilet paper from said roll.

10. The starwheel of claim 9 wherein said plurality of threaded holes at the bottom side (floor) of each of said cutouts facilitating clockwise or counterclockwise rotation of said starwheel may be replaced by just one threaded hole that is centrally located at the bottom side (floor) of each of said cutouts and still permit rotation of said starwheel in either clockwise or counterclockwise direction by simply making the opening of each of said cutouts sufficiently wide so that a roll of toilet paper in the dispension position will not touch either one of the side walls of said cutout thereby permitting a free and smooth unrolling of a sheet of toilet paper from said roll.

11. The hub of said starwheel of claim 1 receives into its bore said smaller-diameter section of said shaft of said base of claim 5 which rotatably supports said starwheel directly and precisely below said hopper of claim 2.

12. The sleeve of claim 1 wherein said bore thru said sleeve houses a spindle, and said enlarged-diameter bore at the far end of said sleeve houses a coil spring, whereby said sleeve guides said spring-loaded spindle as it travels from said slot to slot on said circular-path channel.

13. The coil spring of claim 1 forcibly keeps the bottom end of said spindle on said circular-path channel of claim 1 as it travels from slot to slot on said channel.

14. The spindle of claim 1 wherein said circular collar located precisely somewhere along the length of said spindle abuts against said coil spring that is confined in its housing thereby forcibly pushing said spindle onto said channel on said base as it travels from slot to slot in which said coil spring also forcibly keeps the bottom end of said spindle firmly situated cyclically.

* * * * *